United States Patent [19]

Arnold et al.

[11] Patent Number: 4,665,787

[45] Date of Patent: May 19, 1987

[54] CUTTING DEVICE FOR PAPER AND FOIL WEBS, PARTICULARLY FOR PRINTERS, PLOTTERS, COPIERS AND SIMILAR MACHINES

[75] Inventors: Sieghard E. Arnold, Hildrizhausen; Manfred E. Nitschke, Herrenberg, both of Fed. Rep. of Germany

[73] Assignee: International Business Machines Corporation, Armonk, N.Y.

[21] Appl. No.: 766,841

[22] Filed: Aug. 16, 1985

[30] Foreign Application Priority Data

Aug. 18, 1984 [DE] Fed. Rep. of Germany ..... 3430443

[51] Int. Cl.[4] ..... B26D 1/20

[52] U.S. Cl. ..... 83/485; 83/508; 83/578; 83/579

[58] Field of Search ..... 83/508, 455, 614, 485–489, 83/578, 579

[56] References Cited

U.S. PATENT DOCUMENTS

| | | | |
|---|---|---|---|
| 1,735,520 | 11/1929 | Williams | 83/508 X |
| 2,746,545 | 5/1956 | Chamberlain | 83/508 X |
| 3,161,780 | 12/1964 | Plugge et al. | 307/88.5 |
| 3,958,477 | 5/1976 | Carlson | 83/455 X |
| 4,046,044 | 9/1977 | Paterson | 83/508 X |

FOREIGN PATENT DOCUMENTS

| | | | |
|---|---|---|---|
| 0029122 | 5/1981 | European Pat. Off. . | |
| 110080 | 4/1900 | Fed. Rep. of Germany . | |
| 3333492 | 4/1985 | Fed. Rep. of Germany . | |
| 2389300 | 12/1978 | France | 83/508 |
| 1257782 | 12/1971 | United Kingdom . | |

*Primary Examiner*—Frank T. Yost

*Attorney, Agent, or Firm*—Earl C. Hancock

[57] ABSTRACT

The cutting wheel (40) is rotatably guided in a cutting carrier (50), and under the force of a spring acting axially against the cutting rail (50) so that the cutting wheel (40) is pivotable out of a neutral starting position plane parallel to the cutting rail (50), by an angle ($\alpha_{max}$) corresponding to the maximum admissible cutting angle between cutting wheel (40) and cutting rail (50). Depending on the force ($F_F$) of a spring (46), the cutting resistance ($F_W$), and the frictional force between cutting wheel (40) and cutting rail (50), the cutting wheel (40) adjusts itself automatically to the respective cutting angle ($\alpha_s$). The pivoting range for the cutting wheel (40) extends in both directions, so that the cutting device acts in both directions of movement of the cutting carrier (26).

6 Claims, 4 Drawing Figures

FIG. 1
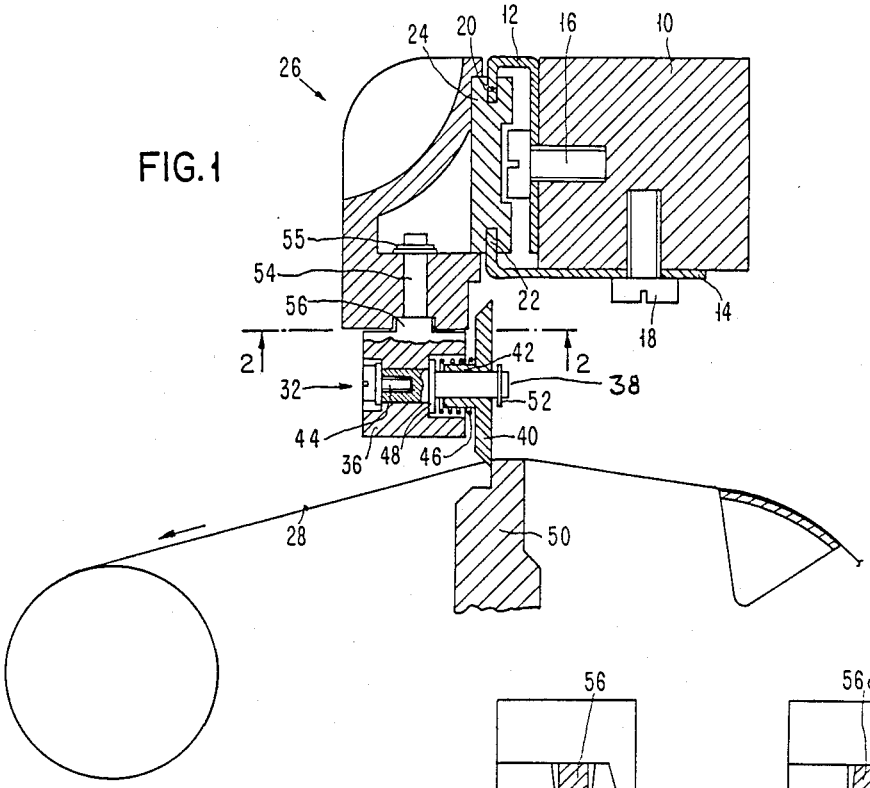
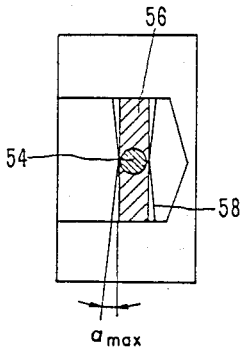
FIG. 2
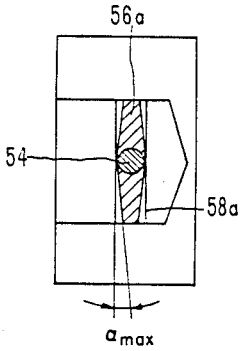
FIG. 3
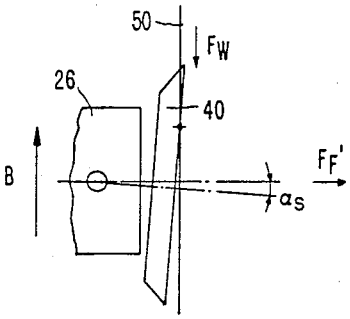
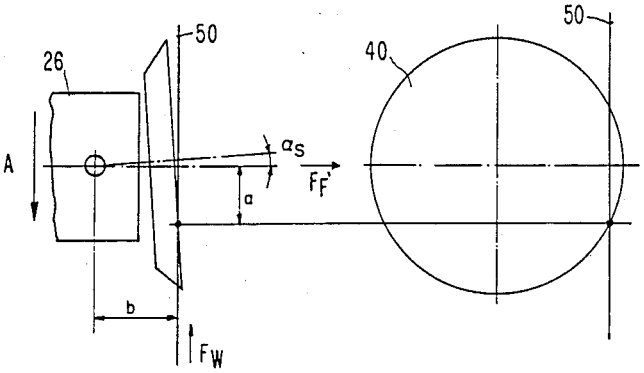
FIG. 4

CUTTING DEVICE FOR PAPER AND FOIL WEBS, PARTICULARLY FOR PRINTERS, PLOTTERS, COPIERS AND SIMILAR MACHINES

The invention relates to a cutting device for paper and foil webs, particularly for printers, plotters, copiers and similar machines, where a cutting wheel rotatably supported in a cutting carrier is movable along a cutting rail over which the web is guided.

In such devices, the cutting wheel is usually supported rotatably in a cutting carrier which for cutting the material is transversally movable over the web, preferably with stationary web advance. This cutting carrier movement is frequently performed manually by means of a corresponding actuator, but it can also be executed by power drive, e.g. by means of an electric or fluid drive.

To achieve a clean cut the cutting wheel in known cutting devices is fixed to a predetermined cutting angle relative to the cutting rail, the rotation axis of the cutting wheel being guided above the edge of the cutting rail, and the cutting angle being measured round the axis extending rectangularly to the cutting wheel axis and to the cutting rail, i.e. in accordance with the angular deviation between the cutting wheel plane and the cutting rail surface facing the cutting wheel. According to the respective operating conditions, particularly for different thicknesses of the material to be cut, the cutting angle can usually be fixed to different values.

The disadvantage of the known cutting devices is that for each modification of the operating conditions, particularly in connection with the processing of materials differing with respect to thickness, stiffness, etc., the cutting angle has each time to be individually fixed, basing on data obtained through experience. Very stiff paper, to give an example, needs a wider cutting angle for an optimal cutting process than thin, flexible paper. The same applies to the processing of foils, but in that connection the cutting angles used for different foil thicknesses frequently differ from those used for paper.

Another disadvantage of the known cutting devices consists in that owing to the fixed setting of the angle between cutting wheel and cutting rail the web of material can be cut in one direction only, and the cutting carrier has to be returned into its starting position for each cutting process. Consequently, cutting requires twice the time of the actual cutting process, irrespective of whether the carrier is moved manually or by power drive.

It is the object of the present invention to provide a cutting device of the above described type, for cutting different materials and with increased effectivity, with the well-known operating principle being maintained. According to the invention, this object has been achieved in that the cutting wheel is kept under the force of a spring acting axially, in the direction of the cutting rail, and supported from a neutral starting position plane parallel to the cutting rail, pivoting by an angle corresponding to the maximum admissible angle between cutting wheel and cutting rail round the axis extending rectangularly to the cutting wheel axis and the cutting rail.

The cutting device as disclosed by the invention ensures optimum cutting of the material involved, without any adjusting or re-adjusting processes being required for different web material, or after a long period of operation. If the cutting wheel according to the inventive idea is supported in such a manner that it can be pivoted in both directions from its starting position, this has the added specific advantage that the web can alternatingly be cut in both directions without the cutting carrier having to carry out an idle (return) motion in between.

A preferred and particularly simple embodiment of the invention consists in guiding the cutting wheel comprising a spring in a cutting wheel support which in turn is pivotably mounted in the cutting carrier. The cutting wheel support can be pivotably mounted by means of a pin in the cutting carrier, and guided by a blockshaped guiding projection in a groove in the cutting carrier whose sides diverge bilaterally round an angle corresponding to the maximum admissible cutting angle between cutting wheel and cutting rail. On the other hand however the groove can also be equipped with parallel sides, and the guiding projection can instead be designed in its outline as an equilateral parallelogram whose acute angle is twice the maximum admissible cutting angle between cutting wheel and cutting rail, and whose acute angle ends are truncated.

In the following, the invention will be described in an embodiment with reference to the drawings.

The drawings show the following:

FIG. 1 a sectional view of a cutting device for paper and foil webs, with automatic cutting angle, and for cutting in both advance directions of the cutting carrier, FIG. 2 a detail plan view of the pivotable mounting of the cutting wheel support in the cutting carrier of the device according to FIG. 1, FIG. 3 a detail plan view of a modified design of the pivotable mounting of the cutting wheel support in the cutting carrier, and FIG. 4 a basic representation of the geometric ratios and forces between the resilient and pivotable cutting wheel and the cutting rail to specify the self-adjusting of the cutting wheel relative to the respective cutting angle.

According to FIG. 1, guide rails 12 and 14 are affixed with screws 16 and 18 to bilateral frame parts 10 of a device, said screws protruding in grooves 20, 22 of slide head 24 of a cutting carrier 26. Consequently, cutting carrier 26 can be displaced over the width of a paper or foil web 28, in the following called "web", for which purpose it is equipped with a handle 30.

A cutting wheel support 32 consists of a support body 36 with a stepped boring where an axle 38 for cutting wheel 40 is fixed by means of a screw 44.

Cutting wheel 40 shows a hub 42 carrying a compression spring 46. Compression spring 46 rests internally against a collar 48 at axle 38, and externally against cutting wheel 40 so that the latter rests against cutting rail 50. For axially securing cutting wheel 40 on axle 38 a retainer 52 is provided. Cutting wheel support 32 is pivotably suspended through pin 54 from cutting carrier 26, pin 54 being secured by a C-shaped retainer 55. In order to limit the pivoting motion of cutting wheel support 32 to the maximum admissible cutting angle, a block-shaped guiding protection 56 is formed on its upper side, said projection protruding into a groove 58 in cutting carrier 26.

As depicted in FIG. 2, the sides of groove 58 in cutting carrier 26 diverge to both sides by angle $\alpha_{max}$ which corresponds to the maximum admissible cutting angle between cutting wheel 40 and cutting rail 50. The same limitation can be achieved by the reversed design of the guiding projection and the groove, as shown in FIG. 3. There, groove 58*a* has parallel sides, whereas the guiding projection 56*a* extends conically to both sides by angle $\alpha_{max}$. Angle $\alpha_{max}$ amounts in practical application to 4° to 5°; a greater angle would impede the cutting process and might block the cutting wheel at the cutting rail.

In its starting position with stationary cutting carrier 26 the cutting wheel, under the influence of spring 46, is plane parallel to cutting rail 50, as shown in FIG. 1. If for cutting web 28 cutting carrier 26 is moved along cutting rail 50, cutting wheel 40 adjusts itself in its operating position to a predetermined cutting angle $\alpha_s$. This is shown in FIG. 4. If the cutting carrier moves in direction A, cutting wheel 40 adjusts itself with cutting wheel support 32 to cutting angle $\alpha_s$. Each respective cutting angle $\alpha_s$ depends on the geometric ratios and the forces encountered, and results from the following relation of the counter-clockwise and the clockwise moments:

$$F_{F'} \cdot a = (F_{F'} \cdot \mu + F_W) \cdot b$$

with $$F_{F'} = F_F \cos \alpha_s$$

With $F_F$=force of the spring $F_{F'}$=component of the spring force in the direction of the cutting wheel axis in the starting position $F_W$=cutting resistance of the web during cutting $\mu$=friction factor for the friction between cutting wheel and cutting rail a=axis parallel distance, relative to the starting position of the cutting wheel, between the point of rotation of the cutting wheel support and the point of intersection between cutting wheel and cutting rail b=distance in the normal line to the axis of the cutting wheel between the point of rotation of the cutting wheel support and the point of intersection between cutting wheel and cutting rail, as depicted in FIG. 4.

If cutting carrier 50 is moved in the opposite direction B cutting wheel 40, as shown in FIG. 4—if the same web material is assumed—adjusts itself into the opposite direction under the same angle $\alpha_s$, since with respect to the cooperation between cutting carrier, cutting wheel support, cutting wheel and cutting rail there exist symmetrical conditions.

In the above described device therefore cutting wheel 40 selects its own respective cutting angle, depending on the stiffness and thickness of the respective web to be cut. This applies to both directions of advance of the cutting carrier. There also appears the wellknown self-sharpening effect between cutting wheel 40 and cutting rail 50.

We claim:

1. A cutting device having a generally planar cutting wheel (40) which is supported by a carrier (26), and wherein said carrier is movable in a linear direction (A and/or B) parallel to a linear cutting rail (50) over which material (28) to be cut is positioned, the imporvement comprising:

a first shaft (38) extending in a direction perpendicular to said cutting rail when said carrier is not moving relative said cutting rail, means rotatably mounting said wheel on said first shaft, with the plane of said wheel perpendicular to said first shaft, said wheel mounting means including spring means operable to force bias ($F_{F'}$) said wheel against said cutting rail, the plane of said wheel being parallel to said cutting rail when said carrier is not moving relative said cutting rail, means (56,58 or 56*a*,58*a*) including a second shaft (54) rotatably mounting said first shaft to said carrier, said second shaft extending in a direction which is perpendicular to both said first shaft and said cutting rail, such that said cutting rail, said first shaft and said second shaft extend in mutually perpendicular directions, and said last named mounting means including rotation limiting means which is operable to limit rotation of said second shaft to a maximum admissible angle ($\alpha_{max}$) between the plane of said wheel and said cutting rail, whereby upon movement of said carrier to cut said material, the plane of said wheel forms a said permissible angle to said cutting rail, the magnitude of said angle being a function of the force of said spring means, the cutting resistance of said material and the frictional force between said wheel and said cutting rail.

2. The cutting device of claim 1 wherein said carrier is movable in either direction relative said cutting rail, and wherein the plane of said wheel correspondingly forms a said permissible angle of one or an opposite rotation relative said cutting rail.

3. The cutting device of claim 2 wherein said last named mounting means includes a rotation limiting block member (56) which is mounted on said second shaft, said block member having parallel planar side walls which are spaced on opposite sides of said second shaft and are parallel to said second shaft, and a groove (58) within which said block member is contained, said groove having side walls located on opposite sides of said block member to limit rotation of said block member, the side walls of said groove diverging bilaterally by one respective angle corresponding to the maximum admissible cutting angle between said cutting wheel and said cutting rail.

4. The cutting device of claim 3 wherein said maximum admissible cutting angle is about 4° to 5°.

5. The cutting device of claim 2 wherein said last named mounting means includes a rotation limiting block member (56) which is mounted on said second shaft, and a groove (58*a*) within which said block member is contained, said groove having parallel side walls, and said block having side walls representing an equilateral parallelogram whose acute angles are twice the maxmimum admissible cutting angle between said cutting wheel and said cutting rail, and whose acute angle ends are truncated.

6. The cutting device of claim 5 wherein said maximum admissible cutting angle is about 4° to 5°.

* * * * *